US006372015B1

(12) United States Patent
Asai et al.

(10) Patent No.: US 6,372,015 B1
(45) **Date of Patent: *Apr. 16, 2002**

(54) METHOD FOR PRODUCTION OF METAL POWDER

(75) Inventors: Tsuyoshi Asai; Hideo Takatori; Wataru Kagohashi, all of Chigasaki (JP)

(73) Assignee: Toho Titanium Co., Ltd., Chigasaki (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/463,563

(22) PCT Filed: Jun. 12, 1999

(86) PCT No.: PCT/JP99/03087

§ 371 Date: Jan. 31, 2000

§ 102(e) Date: Jan. 31, 2000

(87) PCT Pub. No.: WO99/64191

PCT Pub. Date: Dec. 16, 1999

(30) Foreign Application Priority Data

Jun. 12, 1998 (JP) ..... 10-164824

(51) Int. Cl.[7] ..... B22F 9/12
(52) U.S. Cl. ..... 75/363; 75/367; 75/369
(58) Field of Search ..... 75/363, 367, 369

(56) References Cited

U.S. PATENT DOCUMENTS 4,526,611 A * 7/1985 Yoshizawa et al. ..... 75/363
4,810,285 A * 3/1989 Otsuka et al. ..... 75/369
5,853,451 A * 12/1998 Ishikawa et al. ..... 75/369
6,168,752 B1 * 1/2001 Kagohashi et al. ..... 75/369

FOREIGN PATENT DOCUMENTS

| | | |
|---|---|---|
| JP | A-59-7765 | 1/1984 |
| JP | A-4-365806 | 12/1992 |
| JP | A-5-247506 | 9/1993 |
| JP | A-6-122906 | 5/1994 |
| WO | WO 98/24577 | 6/1998 |

* cited by examiner

*Primary Examiner*—George Wyszomierski
(74) *Attorney, Agent, or Firm*—Oliff & Berridge, PLC

(57) ABSTRACT

A process for production of metallic powder comprising contacting a metallic chloride gas with a reductive gas in a temperature range for a reducing reaction to form a metallic powder and subsequently contacting the metallic powder with an inert gas such as nitrogen gas to cool the powder, wherein the rate of cooling is 30° C. or more for temperatures from the temperature range for the reducing reaction to a temperature of 800°C. or less. The metallic powder is rapidly cooled, which results in suppression of agglomeration of particles in the metallic powder and the growth of secondary particles. Growth of particles of a metallic powder formed in a reduction process into secondary particles through agglomeration after the reduction process is suppressed, and a ultrafine metallic powder having a particle diameter of, for example, 1$\mu$m or less, can be reliably produced.

2 Claims, 3 Drawing Sheets

METHOD FOR PRODUCTION OF METAL POWDER

TECHNICAL FIELD

The present invention relates to a process for production of metallic powders such as those of nickel, copper, and silver which are suitable for various uses such as conductive paste fillers used for electrical parts for multi-layer ceramic capacitors, for titanium bonding materials, and for catalysts.

BACKGROUND ART

Conductive metallic powders such as those of nickel, copper, and silver are useful in internal electrodes in multi-layer ceramic capacitors. In particular, nickel powder has been researched, and especially ultrafine nickel powder produced by a dry production process is seen as being promising. Ultrafine powders having particle sizes of not only less than 1.0 μm but also less than 0.5 μm are in demand because of requirements for forming thin layers and for having low resistance in accordance with trends toward miniaturization and larger capacity in capacitors.

Various kinds of processes for production of metallic powders such as the above have been proposed. As one of the process for production of ultrafine spherical nickel powders having an average particle size in the range of 0.1 μm to a few μm, for instance, Japanese Patent Application, Second Publication No. 59-7765 (7765/84) discloses a process in which a solid mass of nickel chloride is heated and vaporized to form a vapor of nickel chloride, and then hydrogen gas is injected to the nickel chloride vapor at a high velocity, thereby causing a nuclear growth in unstable interface regions. Japanese Patent Application, First Publication, No. 4-365806 (365806/92) discloses a process in which the partial pressure of a vapor of nickel chloride obtained by vaporizing a solid mass of nickel chloride is set in the range of 0.05 to 0.3, and is reduced in a gaseous phase at a temperature ranging from 1004 to 1453° C.

In the processes for production of metallic powders as proposed in the above, the reducing reaction is performed at a temperature of about 1000° C. or more, so that the particles of the metallic powder which easily form secondary particles through agglomeration at temperatures in the temperature range for the reduction process and subsequent processes. As a result, a problem that the required ultrafine metallic powder cannot be reliably produced remains.

DISCLOSURE OF THE INVENTION

Therefore, an object of the present invention is to provide a process for production of metallic powder, in which the growth of particles in a metallic powders formed in a reduction process as secondary particles through agglomeration after a reduction process is suppressed, and a ultrafine metallic powder having a particle size of, for example, 1 μm or less can be reliably produced.

During a process for production of metallic powder in a gaseous phase, metallic atoms are formed at the instant when a metallic chloride gas contacts a reductive gas, and ultrafine particles are formed and grow through collision and agglomeration of the atoms. The particle size of the formed metallic powder depends on conditions such as the partial pressure and the temperature of the metallic chloride gas in the atmosphere of the reduction process. After forming a metallic powder having a required particle size, the metallic powder is generally washed and recovered. Therefore, a cooling process for the metallic powder transferred from the reduction process is provided.

However, as the reduction process is performed at about 1000° C. or at a temperature in a higher temperature range, the particles agglomerate again to form secondary particles while the powder is cooled from a temperature range for the reducing reaction to the temperature at which the growth of the particles stops, and therefore a metallic powder having required particle size cannot be reliably produced. Therefore, the inventors directed their attention to the rate of cooling in the cooling process, and studied the relationship between the cooling rate and the particle size of the metallic powder. As a result, they discovered that agglomeration of particles does not occur when the cooling is rapid, and in particular, that very ultrafine metallic powder can be produced when the powder is cooled at a cooling rate of 30° C./sec or more from a temperature in the temperature range for the reducing reaction to a temperature of 800°C. or less.

The present invention was achieved based on the above research, and provides a process for production of metallic powder comprising contacting a metallic chloride gas with a reductive gas in a temperature range for a reducing reaction to form a metallic powder, and then contacting the metallic powder with an inert gas to cool the powder at a cooling rate of 30° C./sec or more from the temperature range for the reducing reaction to a temperature of 800° C. or less. According to the invention, agglomeration of the particles in the metallic powder after the reduction process is suppressed, and the particle size of the metallic powder formed in the reduction process is maintained. As a result, a metallic powder with required ultrafine particles can be reliably produced.

BEST MODE FOR CARRYING OUT THE INVENTION

Figure 1:
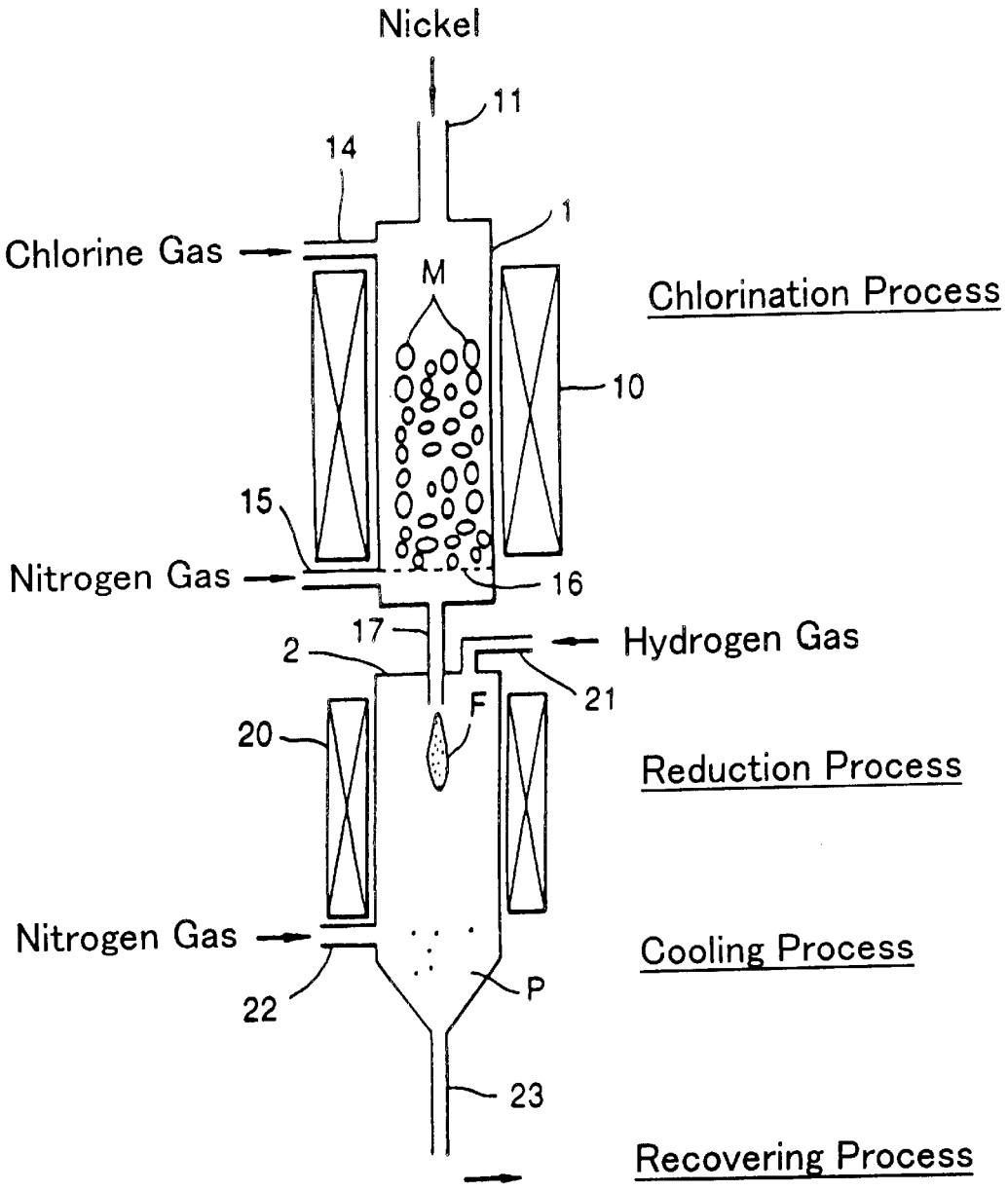
FIG. 1 is a drawing of a vertical cross section showing an example of an apparatus for production of metallic powder according to the present invention.

A preferred embodiment of the invention will be explained hereinafter.

Metallic powders such as those of nickel, copper, and silver suitable for various uses such as conductive paste fillers, for titanium bonding materials, and for catalysts are exemplified for metallic powders produced by the process for production of metallic powders according to the invention. In addition, metallic powders such as those of Al, Ti, Cr, Mn, Fe, Co, Pd, Cd, Pt, and Bi can be produced. Among these powders, the invention is especially suitable for production of nickel powder.

Hydrogen gas and hydrogen sulfide gas and the like can be used as a reductive gas for forming a metallic powder; however, hydrogen gas is more suitable in consideration of undesirable effects on the formed metallic powder.

The kind of inert gas for rapidly cooling the formed metallic powder is not limited as long as the inert gas does not affect the formed metallic powder; however, nitrogen gas and argon gas are preferably employed. Among these gases, nitrogen gas is inexpensive and is preferable.

The processes and conditions for production of metallic powders according to the invention are explained hereinafter.

In the invention, first, a metallic chloride gas is contacted and reacted with a reductive gas, and as the method therefor, well known methods can be employed. For instance, a method in which a solid mass of metallic chloride such as nickel chloride is heated and vaporized to a metallic chloride gas, which is contacted with a reductive gas, can be employed. Alternatively, a method in which a desired metal is contacted with chlorine gas to continuously generate a metallic chloride gas, which is directly supplied to a reduction process to contact the metallic chloride gas with a reductive gas, can be employed.

Among these methods, in the former method in which a solid metallic chloride is used as a raw material, heating and vaporization are essential, and therefore it is difficult to stable generate the vapor. As a result, the partial pressure of metallic chloride gas fluctuates, and the particle size of the produced metallic powder cannot be stable. Moreover, a solid mass of nickel chloride includes water in crystal matrix, which requires dehydration before use, and results in oxygen contamination of the produced nickel powder if the dehydration is insufficient. Therefore, the later method in which a metal is contacted with chlorine gas to continuously generate a metallic chloride gas, which is directly supplied to a reduction process to contact the metallic chloride gas with a reductive gas, is preferable.

In the latter method, as a metallic chloride gas is generated in an amount according to the amount of supply of chlorine gas, the amount of metallic chloride gas which is supplied to the reduction process can be controlled by controlling the amount of chlorine gas supplied. Moreover, as the metallic chloride gas is generated by the reaction of the chlorine gas with the metal, consumption of a carrier gas can be reduced, and under production conditions, no carrier gas is necessary, compared to the method in which a solid mass of metallic chloride is heated and vaporized to form a metallic chloride gas. Therefore, the consumption of the carrier gas can be reduced, and accordingly, energy for heating can be reduced, so that production costs can be lowered.

The partial pressure of the metallic chloride gas in the reduction process can be controlled by mixing an inert gas with the metallic chloride gas generated in a chlorination process. By controlling the amount of the chlorine gas supplied or the partial pressure of the metallic chloride gas which is supplied to the reductive process, the particle size in the formed metallic powder can be controlled.

For example, when a nickel powder is produced by the above method, the form of the metallic nickel as a raw material is not limited, but is preferably masses, plates, or granules having a particle size ranging from 5 to 20 mm in consideration of the contacting efficiency and suppression of pressure loss. The purity of the metallic nickel is preferably about 99.5% or more. The temperature in the chlorination reaction is 800° C. or more for promoting the reaction, and the upper limit of the temperature in the chlorination reaction is 1483° C. which is the melting point of nickel. The temperature in the chlorination reaction is preferably in the range of 900 to 1100° C. in consideration of the reaction speed and prolonging the service life of the chlorination furnace.

The temperature range for the reducing reaction in which the metallic chloride gas is contacted with the reductive gas for production of nickel powder is generally in the range of 900 to 1200°C., preferably in the range of 950 to 1100° C., and more preferably in the range of 980 to 1050° C.

Next, in the process of the invention, the metallic powder formed in the reduction process is intentionary cooled by an inert gas such as nitrogen gas. Cooling equipment independent of the reducing reaction system can be provided for the cooling method, but the cooling is preferably performed just after formation of the metallic powder in the reducing reaction in consideration of the suppression of agglomeration in the particles of the metallic powder, which is the object of the invention. By directly contacting the formed metallic powder with an inert gas such as nitrogen gas, the powder is actively cooled at a cooling rate of 30° C./sec or more, preferably 40° C./sec, and more preferably in the range of 50 to 200° C./sec from a temperature in the range of the reducing reaction to a temperature of 800° C. or less, preferably 600° C. or less, and more preferably 40° C. or less. It is preferable to further cool the powder at the same cooling rate as the above to a temperature lower than the above (for example, room temperature to about 150° C.) subsequently.

Specifically, the metallic powder formed in the reducing reaction system is fed as soon as possible to a cooling system, into which an inert gas such as nitrogen gas is supplied to contact with the metallic powder, thereby cooling it. The amount of the inert gas supplied is not limited as long as the cooling rate is kept in the same as the above. In general, the amount of the inert gas supplied is 5 Nl/min or more, preferably in the range of 10 to 50 Nl/min per 1 g of the formed metallic powder. It should be noted that the effective temperature of the supplied inert gas is generally in the range of 0 to 100° C., and is preferably in the range of 0 to 80° C.

After cooling the formed metallic powder in such way as the above manner, the metallic powder is separated and recovered from the mixture of the metallic powder, hydrochloric acid gas, and the inert gas to obtain the metallic powder. For the separation and the recovery, the combination of one or more of a bag-filter, separation by collecting in water or oil, and magnetic separation is preferable, but this is not so limited. Before or after the separation and the recovery, the formed metallic powder may be washed, if necessary, by water or a solvent such as a monovalent alcohol with a carbon number of 1 to 4.

Thus, formation and growth of secondary particles by agglomeration of particles of the metallic powder can be suppressed by cooling the formed metallic powder just after the reducing reaction, and therefore the particle size can be reliably controlled. As a result, ultrafine metallic powder having a narrow particle size distribution and desired particle size, for example, 1 to $\mu$m or less, without coarse particles can be reliably produced.

Advantages and effects of the present invention will be demonstrated the explanations of examples for production of nickel powder with reference to the drawings as embodiments of the invention.

EXAMPLE 1

First, as a chlorination process, 15 kg of a nickel powder as a raw material with an average particle size of 5 mm was charged from a material supply tube 11 into a chlorination furnace 1 as shown in FIG. 1, and the temperature of the atmosphere in the furnace was set to 1100° C. Then, chlorine gas was fed at a flow rate of 1.9 Nl/min from a chlorine gas supply tube 14 into the chlorination furnace 1, thereby chlorination the metallic nickel and generating $NiCl_2$ gas. Nitrogen gas was fed at a flow rate of 10% of the flow rate of the chlorine gas (molar ratio) from an inert gas supply tube 15 provided at the bottom side of the chlorination furnace 1 into the chlorination furnace 1, and was mixed with the $NiCl_2$ gas. A mesh 16 is preferably provided at the bottom of the chlorination furnace 1 so as to collect the raw material nickel powder thereon.

Next, as a reduction process, the mixed gas of $NiCl_2$ gas and nitrogen gas was fed at a flow rate of 2.3 m/sec from a nozzle 17 into a reduction furnace 2 in which the temperature of the atmosphere is maintained at 1000° C. by a heating device 20. Simultaneously, hydrogen gas was fed at a flow rate of 7 Nl/min from a reductive gas supply tube 21 provided at the top portion of the reduction furnace 2 into the reduction furnace 2, thereby reducing the $NiCl_2$ gas. While the reducing reaction between the $NiCl_2$ gas and the hydrogen gas is proceeding, a luminous flame F, which is similar to a flame of a burning liquid fuel such as LPG, extends downward, and is formed from the end of the nozzle 17.

After the reduction process, as a cooling process, nitrogen gas was fed at a flow rate of 24.5 Nl/min from a cooling gas supply tube 22 provided at the lower end side of the reduction furnace 2, and was contacted with the nickel powder P formed in the reducing reaction, whereby the nickel powder P was cooled from 1000° C. to 400° C. The cooling rate was 105°C./sec.

Figure 2:
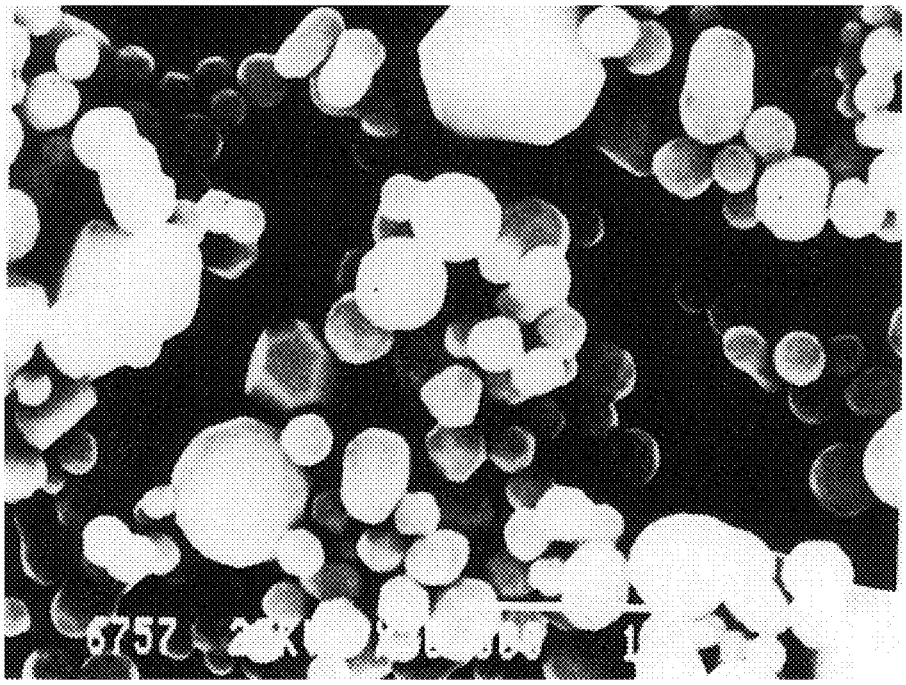
FIG. 2 is a drawing of a scanning electron micrograph of a nickel powder produced in example 1 according to the invention.

Next, as a recovery process, the mixture of nitrogen gas, vapor of hydrochloric acid, and nickel powder P was fed via a recovering tube 23 into an oil scrubber, and the nickel powder P was separated out and recovered. Then, the recovered nickel powder P was washed with xylene, and was dried to obtain the product nickel powder. The nickel powder had an average particle size of 0.16 $\mu$m (measured by the BET method). A scanning electron micrograph of the nickel powder obtained in the example of the invention is shown in FIG. 2, which shows uniform spherical particles without agglomeration.

COMPARATIVE EXAMPLE 1

Figure 3:
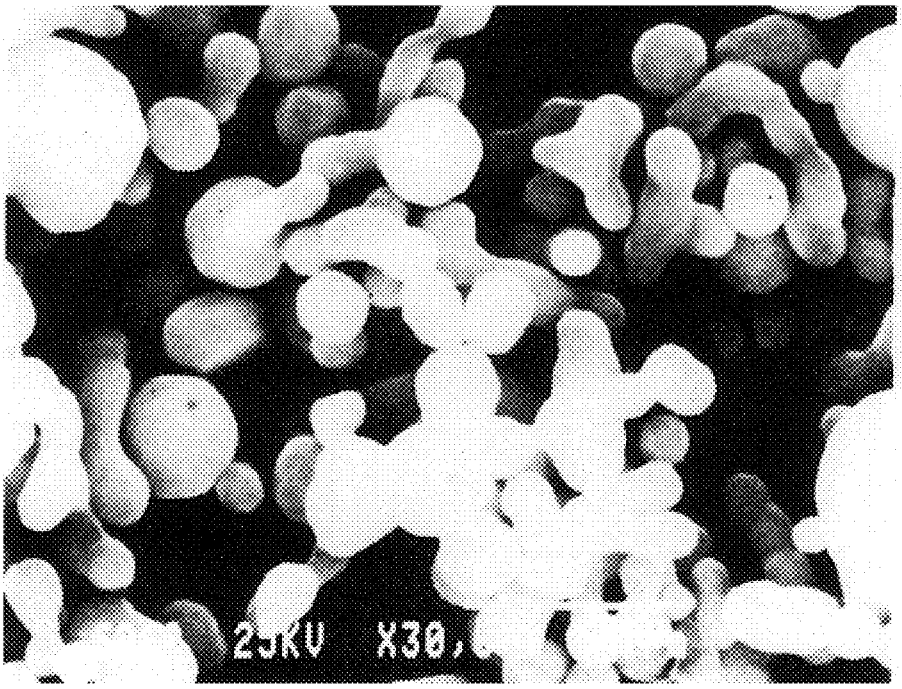
FIG. 3 is a drawing of a scanning electron micrograph of a nickel powder produced in comparative example 1 as a comparison for the invention.

An experiment according to Comparative Examine 1 was performed by the same process as in Example 1, except that the flow rate of nitrogen gas from the cooling gas supply tube 22 was 4.5 Nl/min, and the cooling rate from 1000°C. to 400° C. was 26° C./sec. The average particle size of the resultant nickel powder was 0.29 $\mu$m (measured by the BET method). A scanning electron micrograph of the nickel powder obtained by the comparative example is shown in FIG. 3, which shows secondary particles formed by agglomeration.

As explained above, the process for production of metallic powder of the present invention is one in which by contacting the metallic powder formed in the reducing reaction with an inert gas, the powder is cooled at a cooling rate of 30° C./sec or more from the temperature range for the reducing reaction to a temperature of 800° C. or less, agglomeration of the particles of the metallic powder from the reduction process is suppressed and the particle size of the metallic powder formed in the reduction process is maintained, and therefore the required ultrafine metallic powder can be reliably produced.

What is claimed is:

1. A process for production of a nickel powder, comprising:

contacting a nickel chloride gas with a reductive gas in a reduction process at a temperature of 900 to 1200° C. to form a nickel powder;

transferring a gas containing the nickel powder produced in the reduction process to a cooling process which is performed at a downstream side of the reduction process;

introducing an inert gas into the cooling process; and contacting the nickel powder with the inert gas introduced to cool the nickel powder at a cooling rate of 30 to 200° C. per second to a temperature of 800° C. or less, wherein the inert gas is supplied at a flow rate in the range of 10 to 50 Nl/min per 1 g of the metallic powder.

2. A process for production of a nickel powder, comprising:

contacting a nickel chloride gas with a reductive gas in a reduction process at a temperature of 900 to 1200° C. to form a nickel powder;

transferring a gas containing the nickel powder produced in the reduction process to a cooling process which is performed at a downstream side of the reduction process;

introducing an inert gas having a temperature of 0 to 80° C. into the cooling process at a flow rate of 10 to 50 Nl/min per 1 gram of the nickel powder; and contacting the nickel powder with the inert gas introduced to cool the nickel powder at a cooling rate of 30 to 200° C. per second to a temperature of 800° C. or less.

* * * * *

UNITED STATES PATENT AND TRADEMARK OFFICE

CERTIFICATE OF CORRECTION

PATENT NO. : 6,372,015 B1
DATED : April 16, 2002
INVENTOR(S) : Tsuyoshi Asai et al.

It is certified that error appears in the above-identified patent and that said Letters Patent is hereby corrected as shown below:

Title page,
Item [54], change "METHOD FOR PRODUCTION OF METAL POWDER" to -- PROCESS FOR PRODUCTION OF METALLIC POWDER --.
Item [22], change "Jun. 12, 1999" to -- Jun. 9, 1999 --.

Signed and Sealed this

Thirty-first Day of December, 2002

JAMES E. ROGAN
*Director of the United States Patent and Trademark Office*